US006062722A

United States Patent [19]

Lake

[11] Patent Number: 6,062,722

[45] Date of Patent: May 16, 2000

[54] FLUID MIXING AND WITHDRAWING METHODS

[75] Inventor: Rickie C. Lake, Eagle, Id.

[73] Assignee: Micron Communications, Inc., Boise, Id.

[21] Appl. No.: 08/955,199

[22] Filed: Oct. 21, 1997

[51] Int. Cl.[7] ..... B01F 5/06

[52] U.S. Cl. ..... 366/130; 366/189; 366/268; 366/339

[58] Field of Search ..... 366/130, 341, 366/159.1, 267–269, 336–340, 348, 349, 189; 206/219, 221; 604/416, 903

[56] References Cited

U.S. PATENT DOCUMENTS

| | | | |
|---|---|---|---|
| 2,477,598 | 8/1949 | Hain . | |
| 2,798,488 | 7/1957 | Hall | 366/130 |
| 3,010,705 | 11/1961 | Brown . | |
| 3,261,381 | 7/1966 | Roach . | |
| 3,337,039 | 8/1967 | Knittel et al. . | |
| 3,700,215 | 10/1972 | Hardman et al. | 366/268 |
| 3,860,218 | 1/1975 | Hurlimann | 366/268 |
| 4,350,650 | 9/1982 | Cereghini | 366/267 |
| 4,408,893 | 10/1983 | Rice, III | 366/339 |
| 4,522,504 | 6/1985 | Greverath | 366/339 |
| 4,767,026 | 8/1988 | Keller et al. | 366/339 |
| 4,801,008 | 1/1989 | Rich | 366/339 |
| 4,818,114 | 4/1989 | Ghavi | 366/130 |
| 4,832,500 | 5/1989 | Brunold et al. | 366/268 |
| 4,850,705 | 7/1989 | Horner | 366/339 |
| 5,225,168 | 7/1993 | Khosla | 366/339 |
| 5,358,330 | 10/1994 | Moll | 366/130 |
| 5,425,580 | 6/1995 | Beller | 366/340 |

*Primary Examiner*—Charles E. Cooley
*Attorney, Agent, or Firm*—Wells, St. John, Roberts, Gregory & Matkin P.S.

[57] ABSTRACT

Fluid mixing methods and systems are disclosed. In but one implementation, a fluid mixing method includes providing a mixing passageway having a mixing element therein. A fluid to be mixed is passed in both of opposing directions through at least a portion of the mixing passageway to mix said fluid. In one aspect, at least one fluid reservoir is provided having a mixing passageway connected in fluid communication therewith. Preferably, two fluid reservoirs are provided, with the mixing passageway extending therebetween. A fluid to be mixed is provided in at least one reservoir. At least some of the fluid from the fluid reservoir is flowed into the mixing passageway in a flow direction. After flowing fluid into the mixing passageway, at least some of the fluid within the mixing passageway is flowed in a reversed flow direction and from the mixing passageway back into the fluid reservoir. In another implementation, a fluid mixing system comprises two fluid reservoirs interconnected by a mixing passageway having a mixing element therein.

2 Claims, 3 Drawing Sheets

FLUID MIXING AND WITHDRAWING METHODS

TECHNICAL FIELD

This invention relates to fluid mixing methods and to fluid mixing systems.

BACKGROUND OF THE INVENTION

Electric circuits are frequently constructed by adhering components of the circuit to interconnects with conductive epoxy. Non-conductive epoxies are also utilized in circuit fabrication. Many epoxy systems comprise two components comprising a resin and a hardener. These components are kept separate and mixed immediately prior to application. Depending on the epoxy components, the mixed epoxy may cure in a matter of minutes or hours at room or elevated temperatures. Further, additional components might be added to the epoxy mixture, such as solid fillers.

Regardless, where the epoxy system comprises at least two components to be mixed, complete and thorough mixing to achieve homogeneity in the mix is highly desired to produce a suitable finished epoxy. Such can be achieved, for example, by manually or mechanically stirring a mix of such liquids or components with a stirring device. Static mixing systems have also been utilized in the prior art for mixing epoxy components. One example employs a double-barrelled syringe-like device having a static mixer received at the end thereof. The static mixing system comprises a tube having a static mixer received therein in the form of a plurality of end-to-end oriented split helixes over which the epoxy fluid passes. The nozzles from each syringe barrel feed opposite sides of the first helix. At the juncture with the next helix, the flows are split 50—50 and mix with each other. The split and mixing occurs again at the juncture with the next helix. Thus, longitudinal flow of the epoxy through the static mixing tube, assuming it is long enough, should result in complete homogenous mixing of the two-component system.

The volume of liquid within the mixing tube at the conclusion of processing is typically discarded along with the static mixing tube. Where the mixing tube needs to be of considerable length to achieve adequate mixing, the volume of discarded epoxy components can be significant. This can be costly, for example, where the epoxy being mixed is conductive epoxy. Such typically comprises silver or other metal flakes which significantly add to the cost of the epoxy system. Further, the ultimate volume of mixed epoxy might be quite small due to cost of the epoxy in utilization in the final bonding, such as 60 ml or less. The smaller the desired volume of mixed epoxy, the greater is the percentage of discarded epoxy components of the total mixed volume.

Further, the above static mixing system typically must be increased in length to achieve adequate mixing where the components being mixed differ greatly in volumetric ratio in the finished mix. For example, some epoxy systems use a volumetric ratio of 20:1 of resin to hardener. Typically, the greater the volumetric ratio of mixed components, the more difficult the mixing whether conducting static or dynamic mixing. Longer required static mixing tubes for large volumetric ratios of different components only adds to the discardable product problem.

Accordingly, it would be desirable to develop systems and methods which perhaps enable better epoxy mixing and minimization of discarded material. Although the invention spawned primarily from concerns associated with mixing relatively small volumes of expensive two-part epoxy systems, the artisan will appreciate applicability of the invention in other fluid mixing methods and systems.

SUMMARY OF THE INVENTION

In accordance with the invention, fluid mixing methods and systems are disclosed. In but one implementation, a fluid mixing method includes providing a mixing passageway having a mixing element therein. A fluid to be mixed is passed in both of opposing directions through at least a portion of the mixing passageway to mix said fluid. In one aspect, at least one fluid reservoir is provided having a mixing passageway connected in fluid communication therewith. Preferably, two fluid reservoirs are provided, with the mixing passageway extending therebetween. A fluid to be mixed is provided in at least one reservoir. At least some of the fluid from the fluid reservoir is flowed into the mixing passageway in a flow direction. After flowing fluid into the mixing passageway, at least some of the fluid within the mixing passageway is flowed in a reversed flow direction and from the mixing passageway back into the fluid reservoir. In another implementation, a fluid mixing system comprises two fluid reservoirs interconnected by a mixing passageway having a mixing element therein.

BRIEF DESCRIPTION OF THE DRAWINGS

Preferred embodiments of the invention are described below with reference to the following accompanying drawings.

FIG. 4 is a view of the FIG. 1 mixing system in still another operating configuration.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
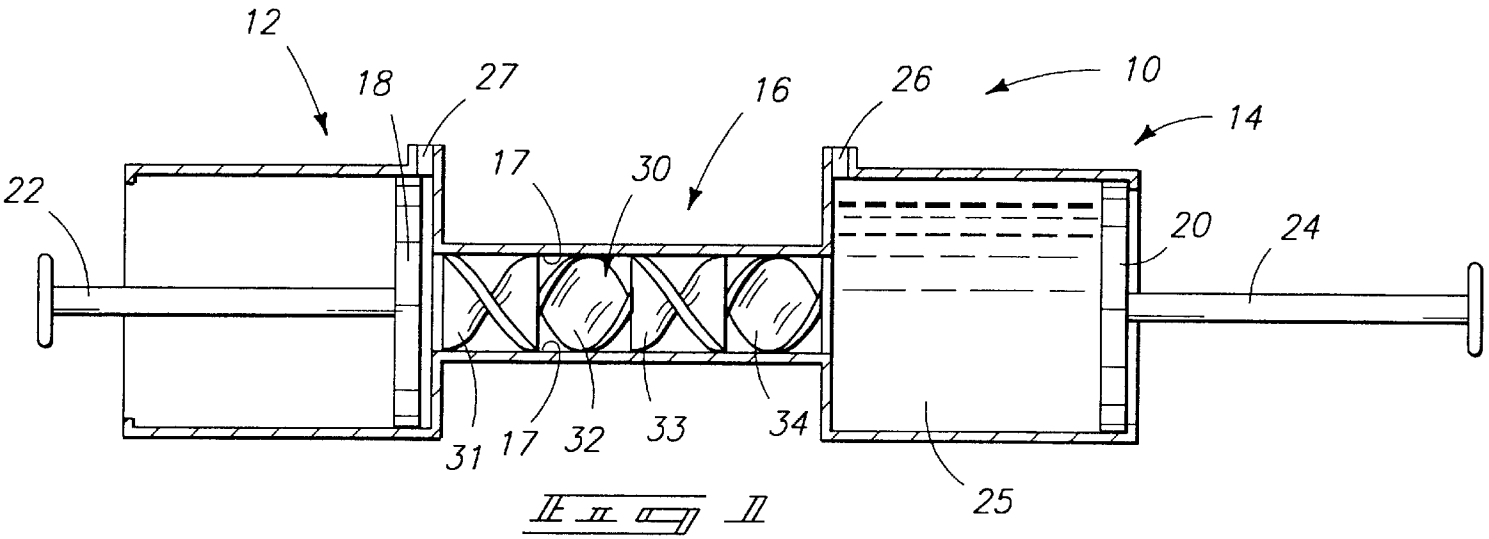
FIG. 1 is a diagrammatic elevational view of a mixing system in accordance with the invention in one operating configuration, and usable in accordance with a method of the invention.

Referring to FIG. 1, a fluid mixing system in accordance with the invention is indicated generally with reference numeral 10. Such is comprised of two reservoirs 12 and 14 interconnected by a mixing passageway 16. Reservoirs 12 and 14 comprise syringe-like devices having respective pistons 18 and 20. Plungers 22 and 24 are rearwardly connected with pistons 18 and 20, respectively. Pistons 18 and 20 are accordingly mounted for movement of fluid within reservoirs 12 and 14, respectively, towards and away from mixing passageway 16. Thus, either piston can be utilized to push or draw fluid relative to its reservoir through mixing passageway 16. A fluid port 26 is included on reservoir 14 proximate where reservoir 14 joins with mixing passageway 16. A fluid port 27 is included on reservoir 12 proximate where reservoir 12 joins with mixing passageway 16. Such can be utilized to inject or withdraw fluid into or out of reservoirs 14 and 12, respectively. Such can also be utilized for air removal from the system. Some form of cap or valve (not shown) is preferably associated with each port 26 and 27 for sealing thereof during mixing.

Mixing passageway 16 is shown provided everywhere linearly extending between reservoirs 12 and 14, and includes internal sidewalls 17. Such includes a mixing element 30 therein to achieve mixing of fluid passing within mixing passageway 16. Mixing element 30 is ideally and most simply configured to be a static mixing element creating a static mixing system resulting from longitudinal flow of fluid in either direction through mixing passageway 16. In the context of this document, a "static mixing system" means any system whereby the mixing element or elements remain stationary as the fluid being mixed passes thereover or therethrough. Accordingly, the preferred mixing element 30 is stationarily received within mixing passageway 16 to constitute a static mixing system. An example is a series or plurality of end-to-end oriented and interconnected split helixes, such as the illustrated helixes 31, 32, 33, and 34. Alternately but much less preferred, a dynamic mixing element could be provided wherein such element, or different element, moves by rotation or otherwise within mixing passageway 16.

Preferably, the mixing element such as in the illustrated form of split helixes is constructed to be a discrete element received within mixing passageway 16. Alternately but less preferred, the mixing element could comprise one or more undivided integral extensions extending internally from mixing passageway internal sidewalls 17.

Exemplary use of the illustrated device and practice of methods in accordance with the invention follows. In one example in mixing a two or more part epoxy system, the resin and the hardener and a totality of any other components to be mixed in the system is initially provided in only one of reservoirs 12 or 14, typically in a predominantly unmixed state. For example, piston 20 could be withdrawn to the right with plunger 24 within reservoir 14, with the position of piston 18 in reservoir 12 not being particularly material at this point. Fluid 25 to be mixed could be injected into reservoir 14 through port 26. Alternately by way of example only, the system could be constructed for removal of piston 20 with plunger 24 from reservoir 14 for providing access for filling such reservoir with the components to be mixed. Further alternately by way of example only, the system can be constructed such that the mixing passageway threads or otherwise removably attaches relative to one or both of reservoirs 12 and 14 for achieving access to the respective reservoirs. In epoxy systems, the fluid components are typically quite viscous such that little flow into mixing passageway 16 occurs between the time of insertion into reservoir 14 and the beginning of the actual mixing.

Figure 2:
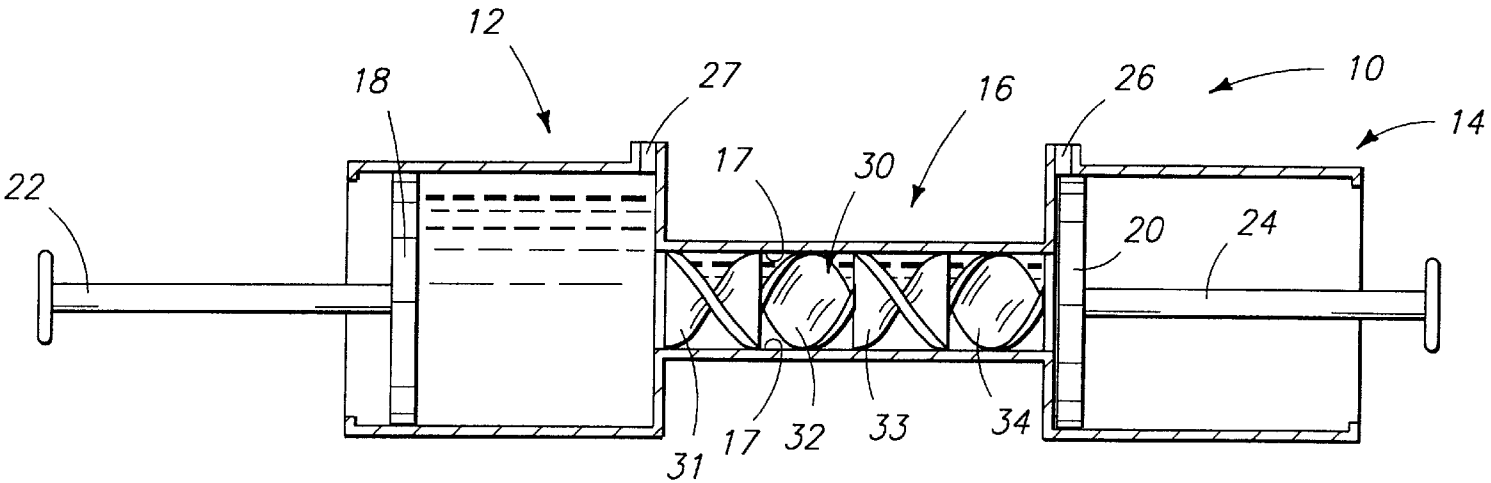
FIG. 2 is a view of the FIG. 1 mixing system in another operating configuration.

Referring to FIG. 2, port 26 is sealed (not shown) and piston 20 is then moved within reservoir 14 to the left to move fluid therein into mixing passageway 16, preferably in combination expelling substantially all the fluid from reservoir 14 into mixing passageway 16 and the other fluid reservoir 12. Accordingly, the fluid as it passes through mixing passageway 16 over mixing element 30 has its individual components mixed to at least some degree. Piston 18 is preferably positioned as shown in FIG. 1 during initial movement of piston 20, and port 27 left open. This will allow air to be purged from the system such that it does not get mixed into the fluid. Upon fluid reaching reservoir 12, port 27 is capped (not shown) to prevent fluid from being expelled therefrom.

Figure 3:
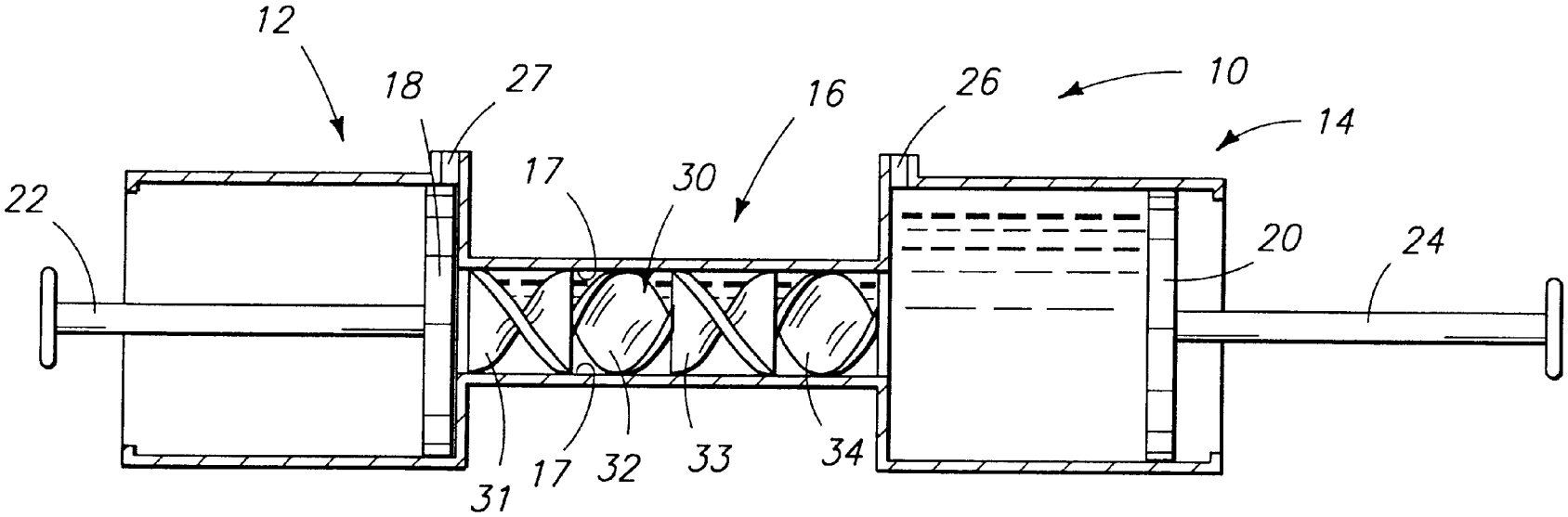
FIG. 3 is a view of the FIG. 1 mixing system in yet another operating configuration.
Figure 11:
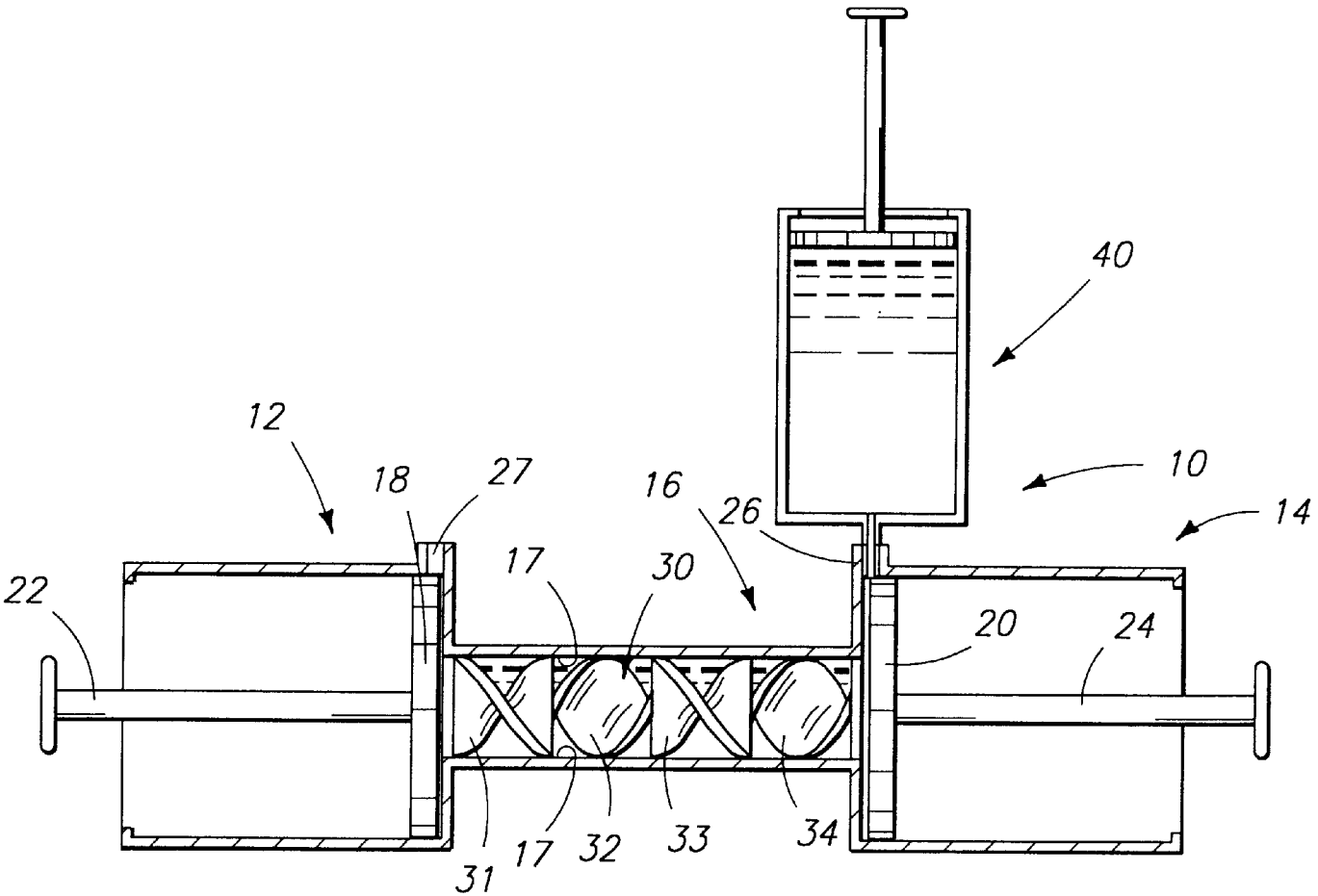

After expelling the fluid from reservoir 14, piston 18 is moved to the right to cause fluid within reservoir 12 into mixing passageway 16, again preferably expelling substantially all the fluid from within reservoir 12 into a combination of mixing passageway 16 and fluid reservoir 14 (FIG. 3). The process can be repeated as many times as desired to achieve desired homogeneity in the fluid/mix.

In accordance with one aspect of the invention, at least some fluid is caused to flow both into and out of each reservoir at least once for each reservoir through mixing passageway 16. Preferably, each reservoir is substantially emptied during each sequence. Accordingly, fluid is caused to flow within the passageway in one flow direction and subsequently in a reverse flow direction and from mixing passageway 16 back into the fluid reservoir from which it started, with the fluid components being mixed in the process.

Alternately, by way of example only to the above-described process, the two components to be mixed (such as epoxy and hardener) can initially be provided separate within the respective reservoirs 12 and 14, with one of the liquids then being forced from one reservoir through the mixing tube into the other reservoir housing the other liquid. Subsequent flow back and forth through the mixing passageway can be conducted a suitable number of times to achieve desired mixing. Such mixing again preferably comprises a static mixing system whereby mixing element 30 inherently remains stationary during passage of fluid through mixing passageway 16.

An exemplary method of withdrawing fluid at the conclusion of the mix is described with reference to FIG. 4. Fluid port 26 can be suitably configured to receive a syringe 40 or some other device. Piston 20 is positioned such that its face is rearwardly proximate fluid port 26, and held stationary thereat. Piston 18 from reservoir 12 is moved to the right, causing mixed fluid to flow one last time through mixing passageway 16 and then out of fluid port 26 into syringe 40. Alternately by way of example only, piston 18 could be held stationary in the position shown in FIG. 1, while piston 20 is moved to the left with the syringe 40 attached to cause mixed fluid within reservoir 14 to flow out of port 26 into syringe 40. Such provides examples where withdrawal of mixed fluid occurs from only one of reservoirs 12 or 14 and separate from mixing passageway 16 upon conclusion of the mixing. Pistons 18 and 20 constitute but one example of a pressurizing means for causing fluid to flow from, a) one reservoir to the other through the mixing passageway, and b) from the other reservoir to the one through the one reservoir. Alternate examples could of course be used. By way of example only, gas pressurization might also be utilized to raise pressure sufficiently to cause the desired flow.

The above-described system and method can be particularly adapted in mixing epoxies or other liquids where either or both of the end volume of fluid being mixed is less than or equal to 60 ml, or where a volumetric ratio of one component to another in a two-component system is greater than or equal to 6:1. The system also enables a shorter length of a static mixing tube to be utilized in achieving desired homogeneity in a mix due to multiple passes occurring through the mixing tube in accordance with methodical aspects of the invention.

In even broader methodical aspects of the invention, a single fluid reservoir might be utilized in combination with a mixing passageway having a mixing element therein. In accordance with one implantation, a fluid to be mixed is provided within such fluid reservoir. At least some of that fluid is caused to flow from the fluid reservoir into the mixing passageway in a first flow direction. After said flowing into the mixing passageway, at least some of that fluid within the mixing passageway is caused to flow in a direction reversed to the first flow direction and from the mixing passageway back into the one fluid reservoir. In accordance with still a broader aspect of the invention, a fluid to be mixed is caused to pass in both of opposing directions through at least a portion of the mixing passageway to mix the fluid.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A fluid mixing method comprising:

providing a pair of fluid reservoirs interconnected with one another through a mixing passageway having a mixing element therein, the fluid reservoirs respectively comprising a piston mounted for movement of fluid towards and away from the mixing passageway;

providing a fluid to be mixed within at least one of the fluid reservoirs;

moving the piston in the one fluid reservoir to move fluid therein into the mixing passageway and expelling substantially all the fluid from the one fluid reservoir into the mixing passageway and other fluid reservoir;

after expelling fluid from the one reservoir, moving the piston in the other fluid reservoir to move fluid therein into the mixing passageway and expelling substantially all the fluid from the other fluid reservoir into the mixing passageway and one fluid reservoir; and further comprising holding one of the pistons stationary while moving the other piston to expel fluid from its reservoir, and withdrawing fluid from the reservoir within which the other piston is received.

2. A fluid mixing method comprising:

providing a pair of fluid reservoirs interconnected with one another through a mixing passageway having a mixing element therein, the fluid reservoirs respectively comprising a piston mounted for movement of fluid towards and away from the mixing passageway;

providing a fluid to be mixed within at least one of the fluid reservoirs;

moving the piston in the one fluid reservoir to move fluid therein into the mixing passageway and expelling substantially all the fluid from the one fluid reservoir into the mixing passageway and other fluid reservoir;

after expelling fluid from the one reservoir, moving the piston in the other fluid reservoir to move fluid therein into the mixing passageway and expelling substantially all the fluid from the other fluid reservoir into the mixing passageway and one fluid reservoir; and further comprising holding one of the pistons stationary while moving the other piston to expel fluid from its reservoir into the mixing passageway, and withdrawing fluid from the reservoir within which the one piston is received.

* * * * *